US005514416A

United States Patent [19]

Grimmel et al.

[11] Patent Number: 5,514,416

[45] Date of Patent: May 7, 1996

[54] CROSS FLOW KNIFE COATER FOR APPLYING A COATING TO A WEB

[75] Inventors: Kai Grimmel, Westfalen; Klaus Schmehl, Westphalia, both of Germany; Mark R. Strenger, Woodbury, Minn.; Norbert J. Wallraff, Westfalia, Germany

[73] Assignee: Minnesota Mining and Manufacturing Company, St. Paul, Minn.

[21] Appl. No.: 193,425

[22] Filed: Feb. 8, 1994

[51] Int. Cl.[6] ..... B05D 3/12; B05C 11/04

[52] U.S. Cl. ..... 427/356; 427/358; 118/410; 118/126; 118/123

[58] Field of Search ..... 427/356, 358, 427/428; 118/410, 123, 126

[56] References Cited

U.S. PATENT DOCUMENTS

| | | | |
|---|---|---|---|
| 3,413,143 | 11/1968 | Cameron et al. | 117/120 |
| 3,941,902 | 3/1976 | Wennerblom et al. | 118/410 |
| 4,050,410 | 9/1977 | Stroszynski | 118/410 |
| 4,416,214 | 11/1983 | Tanaka et al. | 118/410 |
| 4,440,809 | 4/1984 | Vreeland | 118/410 |
| 4,643,127 | 2/1987 | Wanke | 118/410 |
| 4,985,284 | 1/1991 | Shibata et al. | 427/428 |
| 5,033,403 | 7/1991 | Mladota | 118/410 |
| 5,209,954 | 5/1993 | Takahashi et al. | 118/410 |

FOREIGN PATENT DOCUMENTS

| | | |
|---|---|---|
| 0545259A1 | 6/1993 | European Pat. Off. . |
| 1297769 | 5/1962 | France . |
| 2228685 | 1/1974 | Germany . |
| 3907846A1 | 9/1989 | Germany . |
| 1024792 | 4/1966 | United Kingdom . |
| 2124107 | 2/1984 | United Kingdom . |

OTHER PUBLICATIONS

Ortman, Bryan J. and Donigian, Douglas W., *Mechanism and prevention of coat weight nonuniformity due to high speed blade coating*, Sep. 1992 Tappi Journal, pp. 161–169.

Li, Alfred C. and Burns, James R., *Effects of air entrainment on coat weight distributions with an enclosed pond applicator*, Sep. 1992 Tappi Journal, pp. 151–159.

Hwang, S. S., *Hydrodynamic Analyses of Blade Coaters*, Chemical Engineering Science, vol. 34, pp. 181–189 (no date).

*Primary Examiner*—Shrive Beck
*Assistant Examiner*—Katherine A. Bareford
*Attorney, Agent, or Firm*—Garry L. Griswold; Walter N. Kirn; Charles D. Levine

[57] ABSTRACT

A cross flow knife coater includes a coating station through which a surface passes and a trough which extends transversely across the desired width of the coating. The trough has an opening through which coating fluid exits onto the surface without using a slot, and first and second transverse ends. The coating fluid is fed directly into the trough at a first transverse end, and is moved from the first transverse end of the trough, across the trough, and toward the second transverse end to cause the coating fluid to flow across the width of the trough while coating fluid exits the opening. The coater creates a spiral flow of coating fluid across the width of the trough which carries debris, bubbles, and other undesirables across the trough to a second traverse end where they can be vented. The perpendicular distance between the trough opening and the surface, and likewise between the knife and the surface, can be adjusted.

5 Claims, 5 Drawing Sheets

CROSS FLOW KNIFE COATER FOR APPLYING A COATING TO A WEB

TECHNICAL FIELD

The present invention relates to devices for applying coatings to webs. More particularly, the present invention relates to improved knife coaters.

BACKGROUND OF THE INVENTION

Coating is the process of replacing the gas contacting a substrate, usually a solid surface such as a web, with a layer of fluid, such as a liquid. Sometimes, multiple layers of a coating are applied on top of each other. Often the substrate is in the form of a long continuous sheet, such as a web, wound into a roll. Examples are plastic film, woven or non-woven fabric, or paper. Coating a web involves unwinding the roll, applying the liquid layer to the roll, solidifying the liquid layer, and rewinding the coated web into a roll.

After deposition of a coating, it can remain a liquid such as in the application of lubricating oil to metal in metal coil processing or the application of chemical reactants to activate or chemically transform a substrate surface. Alternatively, the coating can be dried if it contains a volatile liquid, or can be cured or in some other way treated to leave behind a solid layer. Examples include paints, varnishes, adhesives, photochemicals, and magnetic recording media.

Methods of applying coatings to webs are discussed in Cohen, E. D. and Gutoff, E. B., *Modern Coating and Drying Technology*, VCH Publishers, New York 1992 and Satas, D., *Web Processing and Converting Technology and Equipment*, Van Vortstrand Reinhold Publishing Co., New York 1984, and include knife coaters.

Knife coating involves passing the liquid between a stationary solid member, a knife, and the web so that the clearance between the knife and the web is less than twice the thickness of the applied liquid layer. The liquid is sheared between the web and the knife, and the thickness of the layer depends to a great extent on the height of the clearance. For many materials and operating constraints, knife coaters have the advantage over other applicators of providing smooth coatings, free of waves, ribs, or heavy edges. The web can be supported behind by a roller. The advantage provided by a backup roller is to eliminate the dependence of the coating process upon variations in longitudinal tension across the web, which are common with paper and plastic film substrates. Alternatively, the knife coater can apply a coating directly to a roller, which subsequently transfers the coating to the web.

One feature which distinguishes various knife coaters is the means by which liquid is introduced to the knifing passage. Gravity fed knife coaters, shown in FIG. 1, receive liquid from an open pool contained against the web by a hopper. Large volumes are required to distribute the liquid evenly across wide web widths, requiring substantial cleanup and large material losses during changeover. Also, particles and bubbles can lodge in the gap between the knife and the substrate and produce streaks in the coating, and air entrainment between the liquid layer and the web is difficult to control.

Film fed knife coaters, shown in FIG. 2, receive liquid from a layer applied to the web by some other means, but not yet with the desired thickness, uniformity, or smoothness. Any excess material runs off the knife and is collected for recycle. However, handling the recycle stream without entraining air or debris is difficult. Also, evaporation of the liquid due to the expansive fluid-air interfaces and long residence time can change material properties and expose human operators to harmful vapors. Additionally, if the initial coating layer is applied with gross imperfections, traces of the imperfections are likely to remain after the knifing passage.

Die fed knife coaters, shown in FIG. 3, receive liquid from a narrow slot, which in conjunction with an upstream manifold, distributes evenly across the web the flow feeding the knifing passage. The die includes two plates sandwiched together with a shim or a depression in one plate forming the slot passage. Cleaning the coater, or changing coating widths requires disassembly of the two plates. Moreover, particles and bubbles can lodge in the gap between the knife lip and the web, because there is no other exit for them, producing streaks in the coating. Also, machine direction uniformity of the coating is sensitive to line and pump speed changes because the liquid has no other exit except onto the web (except with extreme overfeeding in which case excess material is squeezed out the upstream passage between the die lips and the web).

Trough fed knife coaters, shown in FIGS. 4A and 4B, receive liquid from a wide slot, or trough, which is fed by a narrow slot and manifold to provide even flow distribution across the web. Cleaning these coaters requires disassembly of the two plates which form the slot and manifold. The coater in FIG. 4A accumulates particles and gels in the trough, which eventually become lodged in the knifing passage to produce streaks. The coater in FIG. 4B overflows on the upweb side of the coater. The overflow is recycled, but is susceptible to entrainment of debris and air.

SUMMARY OF THE INVENTION

A cross flow knife coater of this invention applies a coating fluid onto a surface. The coater includes a coating station through which the surface passes, and a trough which extends transversely across at least the desired width of the coating, having first and second, transverse ends. The trough is fed coating fluid through a port, preferably located at one of the transverse ends. The trough has an opening which extends between the transverse ends, through which the coating fluid exits onto the surface. The coating fluid is caused to flow from the feed port across the width of the trough while coating fluid exits the opening. A knife regulates the thickness of the coating applied on the surface.

The surface can be a transfer roller or a web moving around a backup roller. The coater creates a spiral flow of coating fluid across the width of the trough, by moving the web past the trough opening against the fluid while causing the coating fluid to travel across the width of the trough.

Additionally, the coater can include a system which adjusts the width of the coating fluid applied on the surface, including first and second dams positioned within the trough at respective ends. The shape of the dams can correspond to the cross-sectional shape of the trough and the dams can have ports for the coating fluid to enter the trough and for excess coating fluid to exit the trough. The perpendicular distance between the trough opening and the surface can be adjusted and the trough opening is sufficiently wide to allow ready access with fingers or tools to facilitate cleaning when the trough is moved away from the surface. The perpendicular distance between the knife and the surface also can be adjusted to control the coating thickness.

DETAILED DESCRIPTION

The cross flow knife coater 10 has many advantages over known knife coating systems. Changeover from one coating liquid to another is rapid because the coater can be cleaned with minor and very simple disassembly. The coater 10 permits easy access to its interior. Also, the volume of the coater trough is small so that material loss during changeover is minimal. The coating width can be adjusted without stopping the coating operation. Streaks are reduced because of the cross flow and venting of coating liquid, and no air bubbles, gels, or debris are entrained from excessive recycling of coating liquid. Air entrapment at the fluid-web contact point is delayed to higher web speeds. The system is enclosed so evaporation is reduced. Relatively few precision-machined surfaces are required. Coating uniformity across the web can be achieved by simple adjustment of the height of the knifing passage at the two ends. Low pressure in the trough reduces leakage and the need for compensatory bending of the coater components.

The cross flow knife coater 10 is shown as being end fed. This eliminates stagnation regions which would exist with central feeding and simplifies the varying the gap transversely to compensate for fluid pressure drop from the inlet, which is required for transverse uniformity of the coating thickness. Nonetheless, center fed systems can be used while still achieving satisfactory coating and easy access to the trough. Also, no slot is required because the small size of the knife passage provides sufficient resistance to coating flow to adequately distribute the coating liquid.

Figure 1:
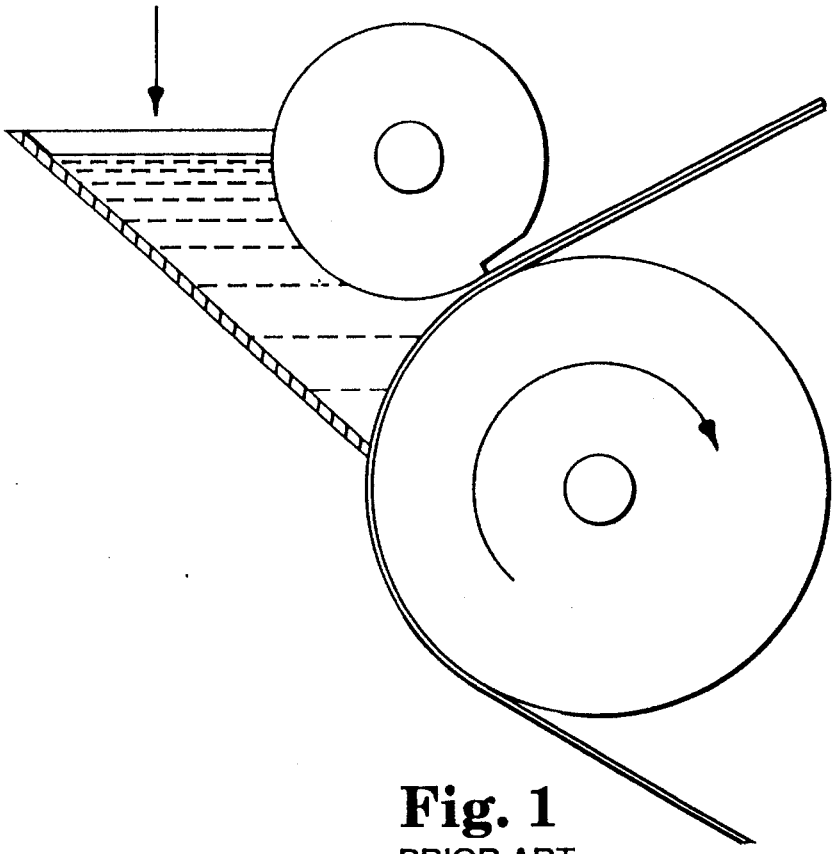
Fig. 1 PRIOR ART
FIG. 1 is a schematic view of a gravity fed knife coater.
Figure 2:
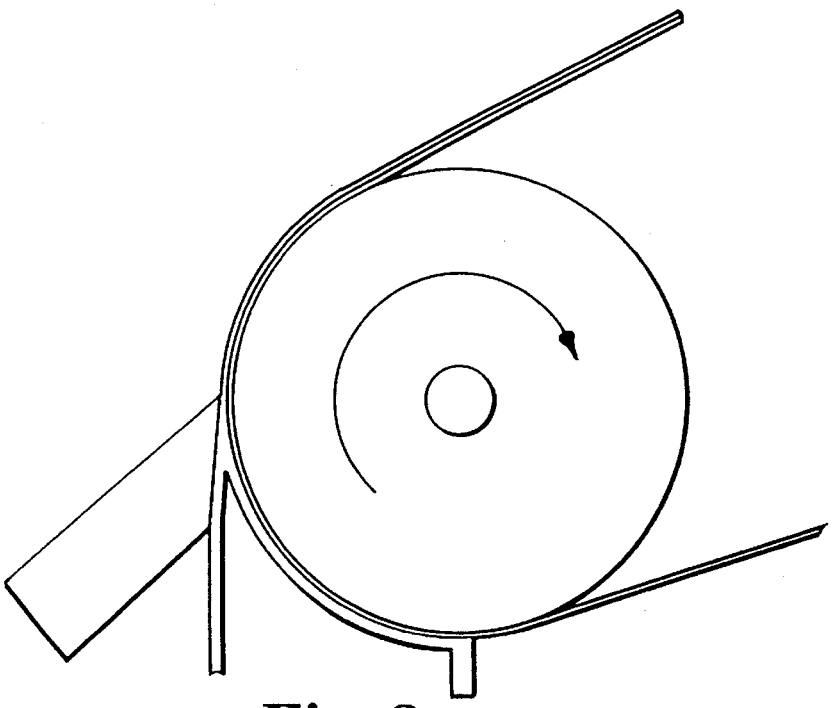
Fig. 2 PRIOR ART
FIG. 2 is a schematic view of a film fed knife coater.
Figure 3:
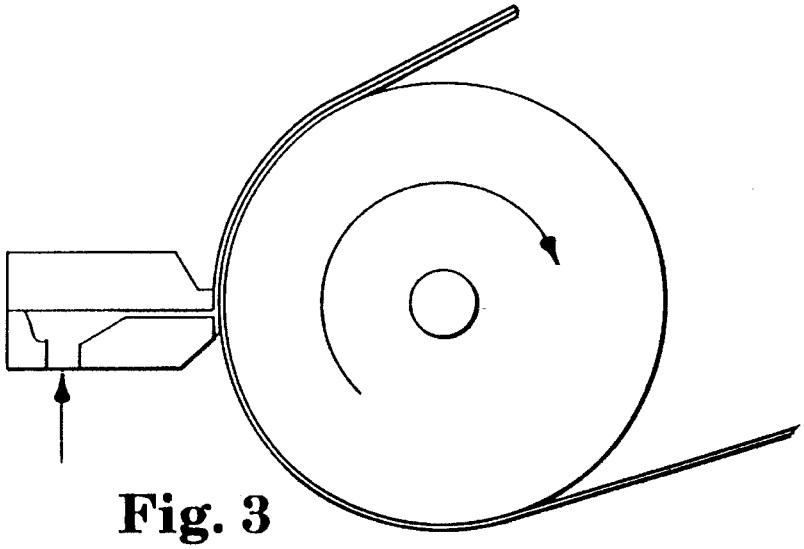
Fig. 3 PRIOR ART
FIG. 3 is a schematic view of a die fed knife coater.
Figure 4A:
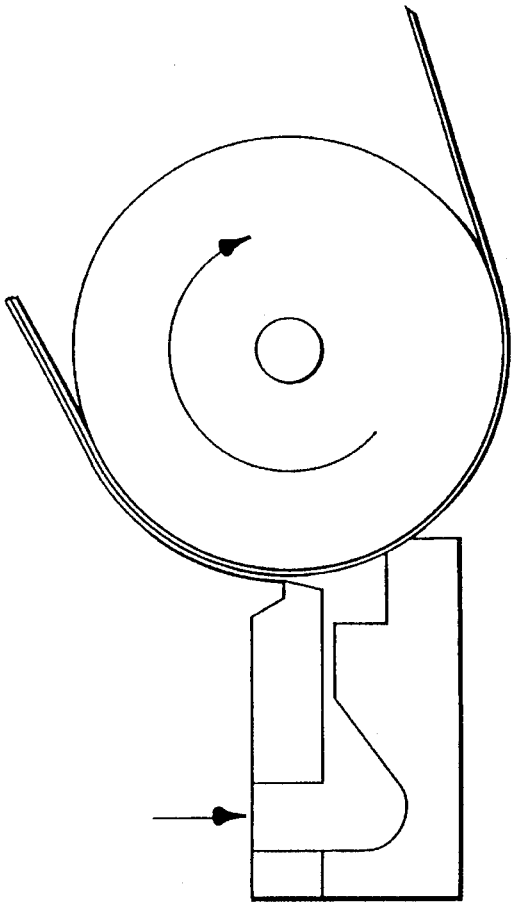
Fig. 4A PRIOR ART
FIGS. 4A and 4B are schematic views of a trough fed knife coater.
Figure 4B:
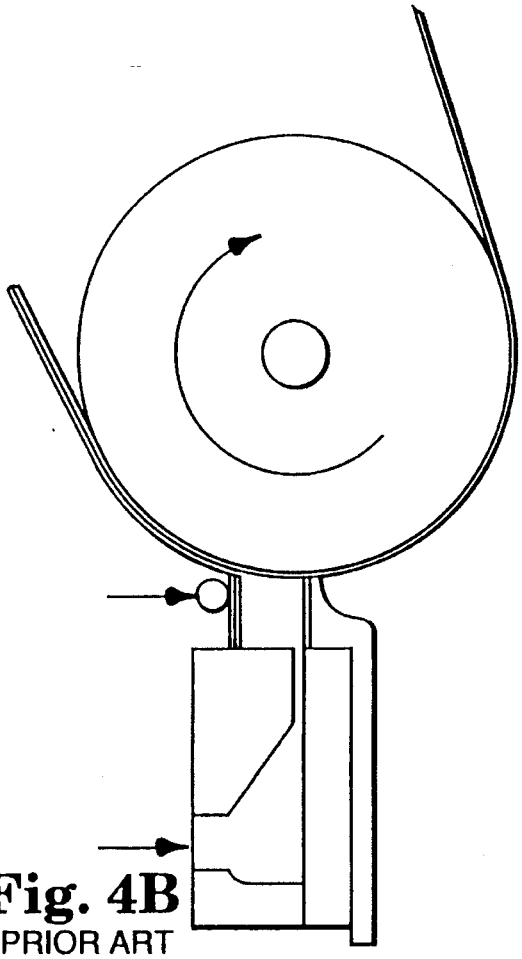
Fig. 4B PRIOR ART
Figure 5:
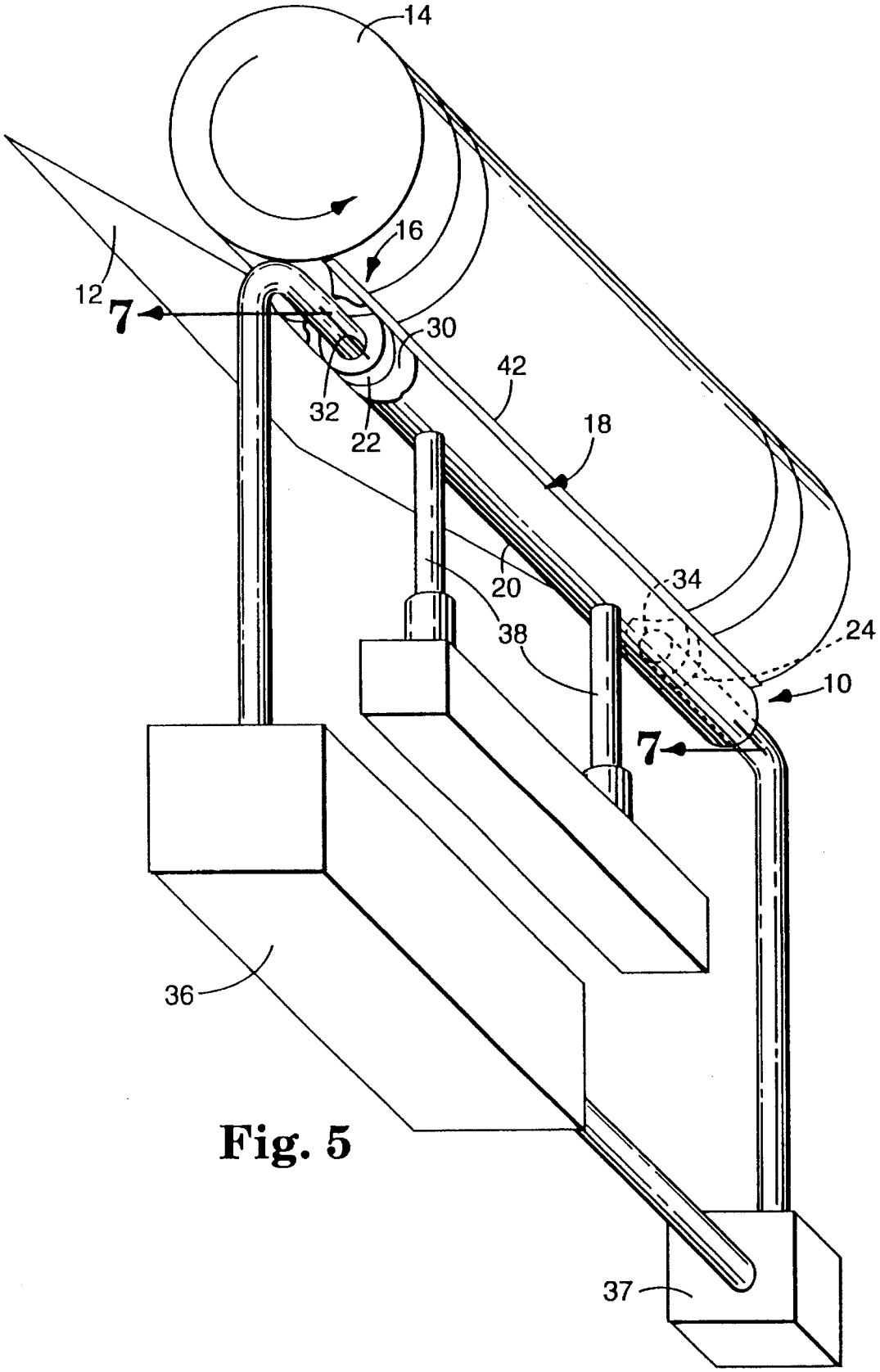
FIG. 5 is a perspective view of the cross flow knife coater of the present invention.
Figure 6A:
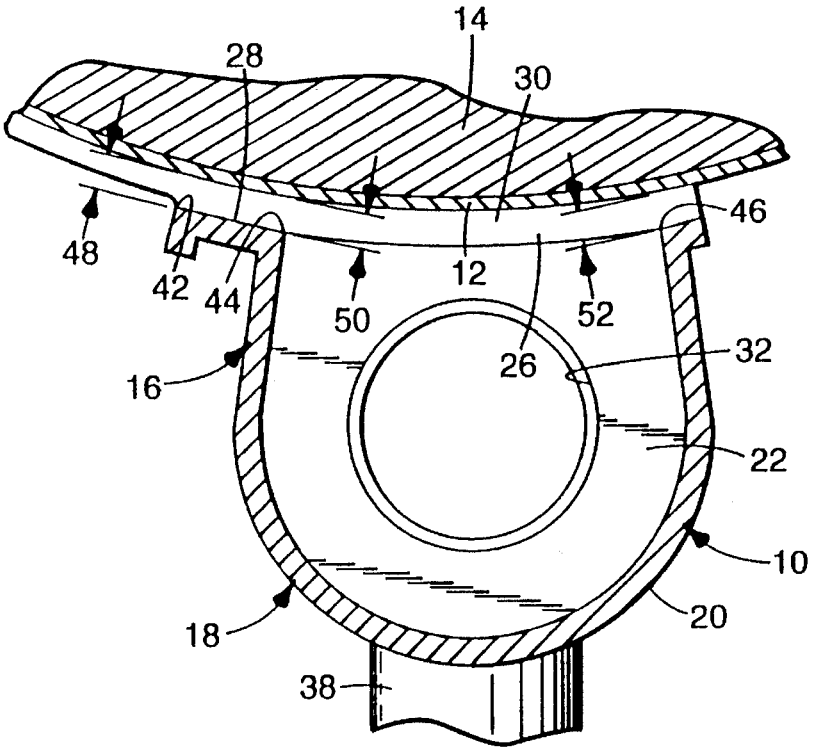
FIG. 6A is a schematic side view of the cross flow knife coater of FIG. 5.
Figure 6B:
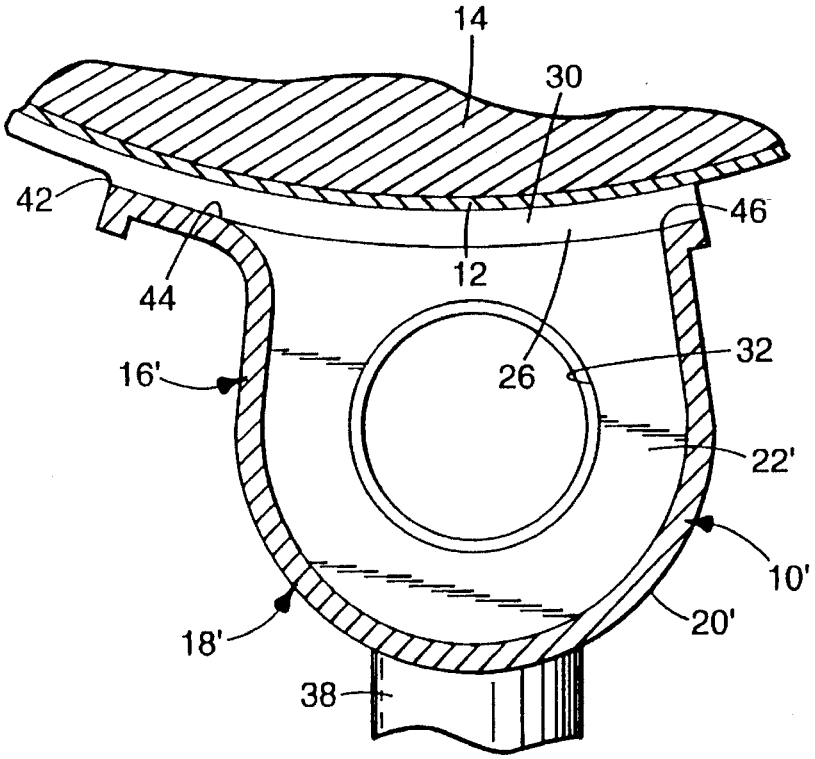
FIG. 6B is a schematic side view of the cross flow knife coater according to another embodiment of the present invention.
Figure 7:
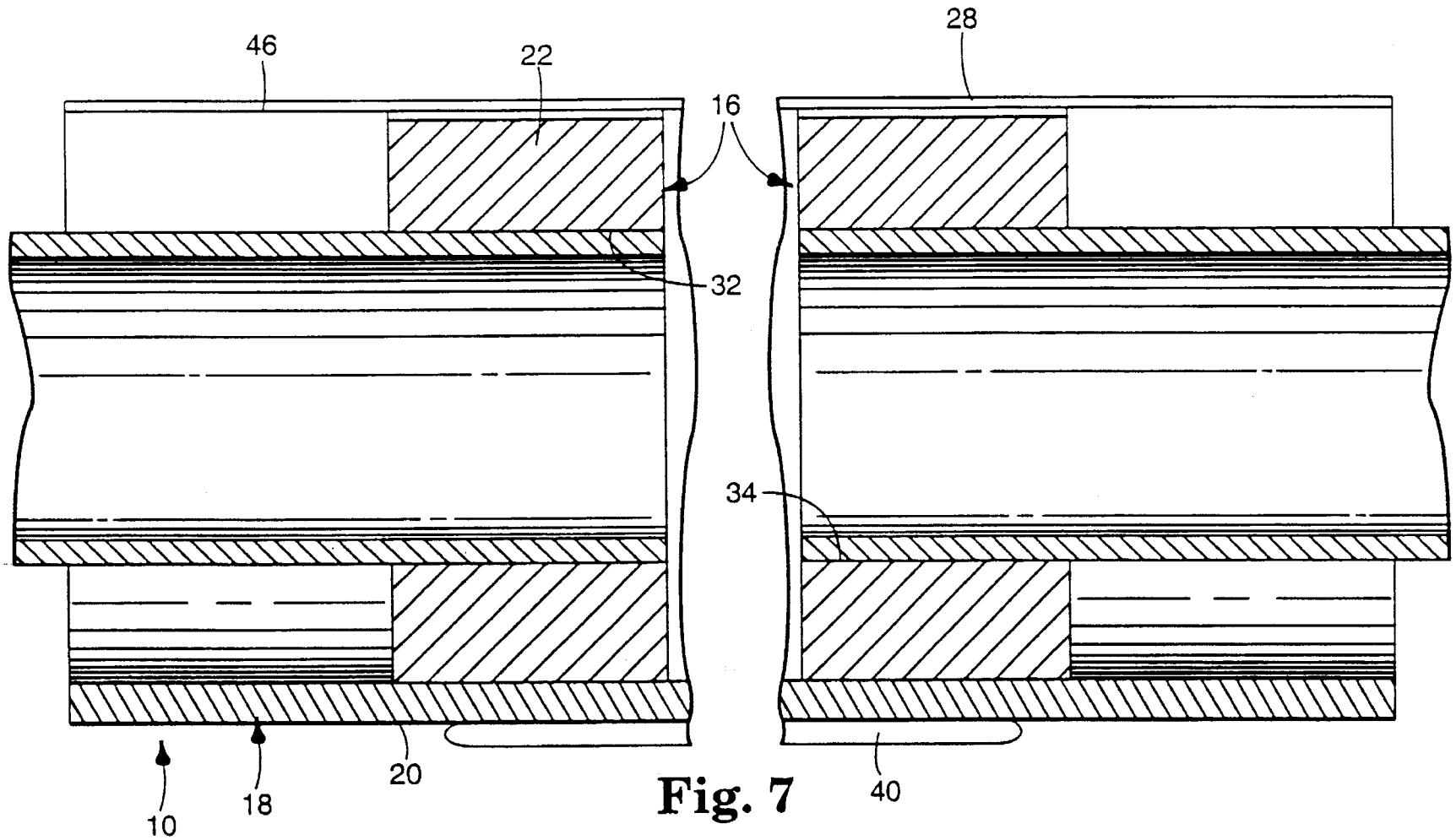
FIG. 7 is a cross-sectional view of the cross flow knife coater of FIG. 5.

As shown in FIGS. 5, 6, and 7 the cross flow knife coater 10 includes a coating station 16 through which a surface to receive coating liquid passes. As shown, the surface is a web 12 passing over and supported against a backup roller 14 which can be deformable. Throughout the specification, the cross flow knife coater 10 and methods are described with respect to coating a liquid directly on a substrate, such as a web 12, moving around a backup roller 14. Alternatively, coatings can be transferred to the substrate using intermediate components such as transfer rollers and other rollers. Other fluids also can be coated. The substrate can be coated against a backup surface, such as the illustrated backup roller 14, or in a free span. Also, the coater opening need not be beneath the substrate.

The coater 10 includes a trough 18, which extends transversely across at least the desired width of the coating. The trough 18 is defined by a curved wall 20, end dams 22, 24 at either transverse end and an opening 26. The web 12 moves through the coating station 16 above the trough opening 26. The dam 22, 24 shape conforms to that of the roller 14 surface. Clearance between the trough 18 and dams 22, 24 and the backup roller 14 is sufficient to allow the web 12 to run through the trough 18 as the roller 14 rotates. However, this clearance at the dams 22, 24 should be small to prevent the coating liquid 30 from spilling out over the dams. The region of clearance between the web 12 and the downweb side of the trough is the knifing passage, through which the coating liquid flows to form the coating. A knife 28 regulates the thickness of the coating liquid 30 applied on the web 12. The region of clearance between the web 12 and the upweb side of the trough 18 provides a dynamic seal designed to prevent liquid from flowing out of the trough at that location. The transverse locations of the dams 22, 24 within the trough 18 can be changed to control the width and transverse location of the coating.

The coating liquid 30 is fed to the trough 18 from a source 36 through a port 32 in one of the dams 22. Any excess coating liquid 30 exits through a port 34 through the opposite dam 24 where it can return, as shown, through a filter or cleaner 37 to the source 36. This port 34 also provides a vent to purge undesirable debris and bubbles which enter the trough 18 along with excess coating liquid 30. The coating liquid 30 is fed by a pump (not shown) at a rate just sufficient to fill the entire trough 18. That rate is equal to the rate at which material leaves the trough opening 26 to be coated, which is controlled by the clearance in the knifing passage, plus the rate of removal of excess coating through the port 34, which is controlled by a valve.

The knife 28 can be a separate element attached to the trough curved wall 20 or it can be a surface of the curved wall. Also, the knife 28 can be planar, curved, concave, or convex. The knife 28 or the backup roller 14 can be flexible, with the gap between the trough 18 and the web 12 being sustained by hydrodynamic pressure.

The trough 18 of the cross flow knife coater 10 can be simply and quickly moved away from the web or other surface being coated. Any conventional components, such as actuators 38 can be used to move the trough 18 to permit access to the interior of the trough 18 for cleaning or other maintenance. Unlike slot coaters in which the die or other component which forms the slot must be disassembled, the trough requires no disassembly.

The cross flow knife coater 10 also includes a system which adjusts the distance between the knife 28 and the web 12. This adjustment system can include actuators 38 mounted on supports on each end of the trough 18. As shown, the same actuators 38 can be used for adjusting the knife clearance and moving the trough 18. Because the liquid pressure near the inlet of the trough 18 is slightly greater than that near the outlet, the knifing clearance must be slightly smaller at the inlet end than at the outlet end to achieve a transversely uniform coating. The adjusting system must provide independent adjustment of the knifing clearance at either end. The actuators 38 can operate independently of each other.

The adjustment system may also counter gravitational, hydrodynamic, thermal, or other stresses which tend to warp the trough 18, the knife 28, and the backup roller 14, thereby resulting in nonuniform deposition of coating across the web 12. Such countering forces can be achieved, for example, with an embedded, fluid filled bladder beneath the trough 18 and extending across the web, or by the discrete microflexible mounts or tuning bolts positioned across the web 12, or by additional actuators 38 between the ends of the trough. Alternatively, the knife 28 and trough 18 assembly can be formed sufficiently rigidly to prevent deflection. Regardless, the trough 18 and knife 18 should be retractable from the backup roller 14 for splice passage, coat-outs, and changeovers.

The trough may be any shape, although it is preferred that it have smooth, continuous walls, as shown, to avoid stagnation of coating liquid, as would occur at corners. The trough 18 is undercut from its opening at the top to hold the edge dams 22, 24 in the trough 18, thereby allowing only linear transverse movement. It is preferred that the trough 18 be located directly beneath the backup roller 14 to avoid spilling any coating fluid 30 when the trough 18 is retracted from the roller 14.

The shape of the trough 18 is constant transversely so that the edge dams 22, 24, which conform to the trough 18, can slide to any position and can be removed easily to facilitate cleaning. The opening 26 at the top of the trough 18 must be wide enough to allow access with fingers or appropriate tools for cleaning the walls of the trough 18 when the trough is moved away from the web 12. The trough 18 opening 26 is much wider than a slot used in slot coating. (Slots typically have a width between 0.00254 and 0.254 cm (0.001 and 0.100 inch) in known commercial operations.)

The cross-sectional area of the trough 18 is large enough to insure a low operating pressure in the trough 18, but is small enough to avoid excessive material waste during changeover. Low trough pressure reduces the separating force between the trough 18 and the backup roller 14, and helps to prevent a break in the dynamic seal.

The coating liquid 30 enters the trough 18 from one transverse end, through the port 32 in the dam 22 and moves across the trough 18 transverse to the direction of web movement. As the coating liquid 30 is applied to the web 12, the web movement in a downweb direction combines with the transverse direction of coating liquid flow across the trough 18 to create a spiral coating liquid flow. Bubbles, gels, or debris particles entering the trough 18 with the coating fluid 30 have been observed to remain in the spiral flow rather than to enter the knifing passage. The slight venting flow through the outlet port 34 purges these and other undesirables. This flow greatly reduces the potential for downweb streaks Caused by bubbles, gels, or debris particles entrapped in the knifing passage.

Referring to FIG. 6A, the knife 28 has a downweb trailing edge 42 and an upweb leading edge 44 collinear with the intersection of the surface of the dam 22, 24 facing the web 12 and the wall of the trough 18 on the downweb side. The trough 18 also has an opposing, upweb edge 46. The trailing knife edge 42 locates the intersection of the coating liquid 30, the knife 28, and the surrounding air, from which the top side of the coating extends. The knife surface and the wall of the trough need not necessarily be discontinuous, as shown in FIG. 6B. The upweb trough edge 46 locates the intersection of the coating liquid 30, the trough 18, and the surrounding air from which a liquid-air interface extends to the intersection of the coating liquid 30, the web 12, and the surrounding air, from which the bottom side of the coating extends. As shown, the top surface of the dams 22, 24 are flush with the upper edges of the trough 18. Alternatively, the top surface could be raised above the upper edges to allow a large clearance in the knifing passage, such as for thick coatings, without allowing transverse seepage of liquid past the dams.

The perpendicular distance 48 from the web 12 to the trailing knife edge 42 is less than twice the thickness of the coated liquid and is the narrowest gap between the web 12 and the knife 28. It may vary slightly from the inlet to the outlet ends of the trough 18 to achieve a uniform coating. The perpendicular distance 50 from the web 12 to the leading knife edge 44 should be slightly greater than the distance 48 to insure a decreasing clearance through the knifing passage to the trailing edge 42 (that is, to provide a shallowly convergent knifing passage). The shape of the knife surface, between its edges 42, 44 may be flat, slightly concave, or slightly convex. The length of this surface should be at least ten times greater than the distance 48. The perpendicular distance 52 from the web 12 to the edge 46 is approximately equal to the distance 50. The distance along the top of the trough 18, between the downweb trough edge (which is collinear with the leading knife edge 44) and the upweb trough edge 46 is sufficiently large to allow ready access to the trough 18 for cleaning when the trough 18 is retracted from the web 12 and the backup roller 14.

Various changes and modifications can be made in the invention without departing from the scope or spirit of the invention. For example, the invention is easily adapted to a configuration in which the trough is applied to the web in a free, unsupported, span. In this adaptation, the clearance between the trough and the web are sustained by hydrodynamic pressure, which balances the pressure from the deflection of the tensioned web. Likewise, the invention can be used with the configuration in which the trough is applied to a web supported against a deformable backup roller, for example, one covered with a rubber sheath. Similarly, the clearance is sustained by hydrodynamic pressure, such as by balancing the pressure from the deflected elastic surface. Alternatively, the knife itself could be deformable. (A deformable knife is often referred to as a blade.)

We claim:

1. A method of applying a coating fluid, having a thickness, on to a surface comprising:

providing relative movement between the coating apparatus and the surface;

applying coating to the surface using a trough which extends transversely across at least a desired width of the coating, wherein the trough has an inner surface and an opening through which coating fluid exits onto the surface, and having first and second transverse ends, wherein the trough opening is sufficiently wide to allow the inner surface to be cleaned without disassembling the trough and to prevent resistance to flow of the coating fluid;

feeding the coating fluid directly into the trough;

flowing the coating fluid across a width of the trough while coating fluid exits the opening; and regulating the thickness of the coating applied on the surface and providing resistance to flow of the coating fluid using a knife;

wherein the step of providing relative movement between the coating apparatus and the surface and the step of flowing the coating fluid across the width of the trough combine to create a spiral flow of coating fluid within the trough and adjacent the trough opening.

2. A method of applying a coating fluid, having a thickness, on to a surface comprising:

providing relative movement between the coating apparatus and the surface;

applying coating to the surface using a trough which extends transversely across at least a desired width of the coating, wherein the trough has an inner surface and an opening through which coating fluid exits onto the surface, and having first and second transverse ends, wherein the trough opening is sufficiently wide to allow the inner surface to be cleaned without disassembling the trough and to prevent resistance to flow of the coating fluid;

delivering coating fluid to the trough to maintain a desired level of coating fluid in the trough;

flowing the coating fluid across a width of the trough while coating fluid exits the opening;

regulating the thickness of the coating applied on the surface and providing resistance to flow of the coating fluid using a knife without requiring additional regulating steps; and maintaining the perpendicular distance between the knife and the surface greater at locations spaced from the means for delivering coating fluid than at locations adjacent the means for delivering coating fluid.

3. A coating apparatus for applying a coating fluid, having a thickness, on to a surface comprising:

means for providing relative movement between the coating apparatus and the surface;

means for applying coating to the surface, wherein the applying means comprises a trough, having a width, which extends transversely across at least a desired width of the coating, wherein the trough has an inner surface and an opening through which coating fluid exits onto the surface, and having first and second transverse ends, wherein the trough opening is sufficiently wide to allow the inner surface to be cleaned without disassembly of the trough and to prevent resistance to flow of the coating fluid;

means for delivering coating fluid to the trough to maintain a desired level of coating fluid in the trough;

means for flowing the coating fluid across the width of the trough while coating fluid exits the opening;

a knife for regulating the thickness of the coating applied on the surface and for providing resistance to flow of the coating fluid; and means for adjusting a perpendicular distance between the knife and the surface and for maintaining the perpendicular distance between the knife and the surface greater at locations spaced from the means for delivering coating fluid than at locations adjacent the means for delivering coating fluid.

4. A coating apparatus for applying a coating fluid, having a thickness, on to a surface comprising:

means for providing relative movement between the coating apparatus and the surface;

means for applying coating to the surface, wherein the applying means comprises a trough, having a width, which extends transversely across at least a desired width of the coating, wherein the trough has an inner surface and an opening through which coating fluid exits onto the surface, and having first and second transverse ends, wherein the trough opening is sufficiently wide to allow the inner surface to be cleaned without disassembly of the trough and to prevent resistance to flow of the coating fluid;

means for adjusting the width of the coating fluid applied on the surface, wherein the adjusting means comprises first and second dams located within the trough at respective transverse ends, and wherein the shape of the dams corresponds to the shape of the trough;

means for feeding the coating fluid directly into the trough comprising a port in the first dam;

means for flowing the coating fluid across the width of the trough while coating fluid exits the opening;

means for removing excess coating fluid from the trough comprising a port in the second dam; and a knife for regulating the thickness of the coating applied on the surface and for providing resistance to flow of the coating fluid, wherein the perpendicular distance between the knife and the surface increases from the first dam to the second dam.

5. A coating apparatus for applying a coating fluid, having a thickness, on to a surface comprising:

means for providing relative movement between the coating apparatus and the surface;

means for applying coating to the surface, wherein the applying means comprises a trough, having a width, which extends transversely across at least a desired width of the coating, wherein the trough has an inner surface and an opening through which coating fluid exits onto the surface, and having first and second transverse ends, wherein the trough opening is sufficiently wide to allow the inner surface to be cleaned without disassembly of the trough and to prevent resistance to flow of the coating fluid;

means for feeding the coating fluid directly into the trough;

a knife for regulating the thickness of the coating applied on the surface and for providing resistance to flow of the coating fluid; and means for flowing the coating fluid across the width of the trough while coating fluid exits the opening at the surface and passes the knife and while no coating fluid exits the opening without passing the knife.

* * * * *